United States Patent [19]

Napoleon

[11] 4,369,799

[45] Jan. 25, 1983

[54] COSMETIC POWDER DISPENSING DEVICE

[76] Inventor: Jo Napoleon, 432 S. Curson Ave., #1-D, Los Angeles, Calif. 90036

[21] Appl. No.: 262,308

[22] Filed: May 11, 1981

[51] Int. Cl.[2] ..... A45D 33/00

[52] U.S. Cl. ..... 132/83 R

[58] Field of Search ..... 132/83 R; 424/63

[56] References Cited

U.S. PATENT DOCUMENTS

| | | | |
|---|---|---|---|
| 1,612,409 | 12/1926 | Anderson | 132/83 R |
| 1,899,732 | 2/1933 | Shields | 132/83 R |
| 1,961,161 | 6/1934 | Nemmers | 132/83 R |
| 2,215,480 | 9/1940 | Sampson | 132/83 R |

*Primary Examiner*—G. E. McNeill

*Attorney, Agent, or Firm*—Paul D. Supnik

[57] ABSTRACT

A device for dispensing an iron oxide based powder makeup includes a hinged thin compact case and an annular module joined to the case interior. Extending across the module, a transverse portion divides the compact into first and second regions. An apertured cover encloses the first region, confining an iron oxide powder makeup therein. A plate mounted cork surface in facing relationship to the cover sparingly receives the iron oxide powder through the aperture array. The cork surfaced plate is coupled to the transverse portion of the module by a live hinge. Plate latches are provided for securing the plate in a first position flush to the cover, and a second position, providing access to the powder adhering cork surface.

21 Claims, 6 Drawing Figures

COSMETIC POWDER DISPENSING DEVICE

BACKGROUND OF THE INVENTION

1. Field of the Invention

This invention relates to cosmetic dispensing devices. More particularly, this invention relates to devices for dispensing makeup preparations of the type comprising naturally occuring mixtures of iron oxide based minerals and synthetic equivalents.

2. Description of the Prior Art

Naturally occuring iron oxide based mineral powders have been used as a form of cosmetic make-up. The powders used have included heavy concentrations of iron oxides. The mixture often contains minerals such as silicon, aluminum, calcium, manganese, magnesium and trace amounts of zinc, titanium boron, chromium, copper, vanadium, molybdenum, nickel and strontium existing in oxide, silicate and carbonate forms as occur in nature. The color is so deep and intense they cannot be applied successfully, as can other cosmetics, simply by dipping a finger, puff or brush into the powder and applying it to the skin. The result would be a "war paint" streak that would be most unattractive and discourage customers from purchasing the powder and attempting to apply it as make-up.

In the past, typical containers for the compound have included a spherical clay jar. The powder is held in place in the spherical jar with a cork. Consumers are advised to shake the jar with cork held firmly in place, so that some of the powder adheres to the cork. The excess powder is to be tapped back into the jar, and the cork used as a "palette" from which to apply the make-up. A puff, make-up brush or a cotton swab is dusted across the surface of the cork, and only a very small amount of the powder is to be picked up. In this way there are able to control the amount of powder, and therefore the intensity of color, they wish to apply to the skin. The control of intensity and amount of powder tends to be important with the use of this type of makeup.

Unfortunately, this container is too bulky and fragile for women to carry in their purses, or even in suitcases or make-up cases when traveling. Motion, such as in a purse or suitcase, could not only cause the container to break. The cork could work loose, spilling the powder into purse or case. This is extremely undesirable because of the intensity of the highly concentrated iron oxides and its staining properties as a raw, undiluted pigment.

These properties have discouraged women from carrying the clay jars of make-up around with them. Thus while they can apply the make-up at home, they cannot "touch up" during the day or evening as they can with competitor's blushers, bronzers, and similar makeup, almost all of which offer a convenient purse and travel size dispenser. This in turn tends to discourage recognition of the practicality of regarding the natural multipurpose powder as a total makeup, i.e., a makeup that can be freshened during the day or evening.

It has been recognized by the consumers, distributors and manufacturers that the powdered make-up goes a long way and it need only be used very sparingly. From the point of view of the distributor or manufacturer, it would be desirable to limit the quantity of material sold in a single container.

Further, the material has a tendency to change color and tends to vary significantly in color, from a dark red to a distasteful purple black color, believed to be seasonal or resulting from the batch to batch variations of the mixture which is mined. Though this does not have a significant effect on the performance of the substance, the consumer is likely to be unnecessarily cautious about purchasing the product, thinking that there might be a lack of uniformity, and it would be advantageous to minimize the visual exposure of the product where unnecessary.

SUMMARY OF THE INVENTION

A cosmetic powder dispensing device in accordance with this invention generally comprises a volumetric chamber, for supporting an iron oxide based cosmetic powder in a confined volumetric region. A cover is provided for enclosing the chamber. The cover defines apertures for sparingly allowing passage of the cosmetic powder from the chamber. An element, including a substantially nonporous makeup adhering surface is movable from a position generally flush to the apertures to a position remote from the apertures. The cosmetic powder when disposed on the adhering surface may then be removed and applied to a wearer.

In a more specific example the volumetric chamber is thin and semicircular in configuration. The cover is generally flat and the adhering surface comprises a cork lamina.

Additional features in accordance with this invention includes a hinge movably coupling the adhering surface to the chamber so that the adhering surface is easily movable from a first position in contact with the aperture means, to a second position in which the hinged flat plate is movable to a position remote from the aperture means, so that a brush may be applied to remove the powdered material from the adhering cork lamina.

BRIEF DESCRIPTION OF THE DRAWINGS

The nature of the invention described herein may be best understood and appreciated by the following description taken in connection with the accompanying drawings in which.

DETAILED DESCRIPTION

Figure 1:
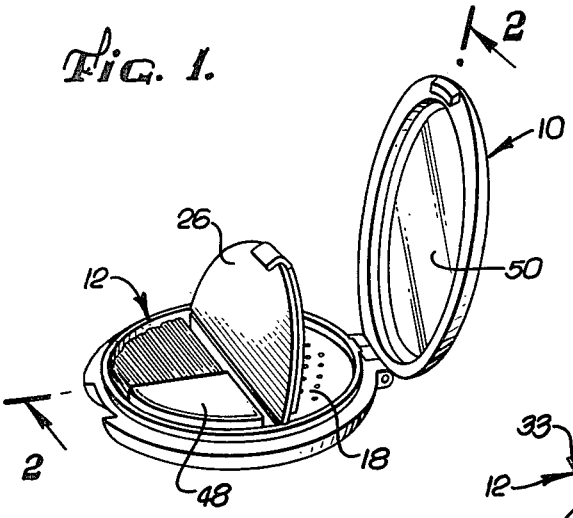
FIG. 1 is a perspective view depicting an example of a cosmetic dispensing device in accordance with this invention.

With particular reference to FIGS. 1, 2, 3 and 4, an example of a cosmetic compact in accordance with this invention generally comprises a compact case 10 and a module 12, typically of plastic, preferably injection molded or vacuum formed, and affixed within the case 10. The case 10 comprises a circular lower shell 11 and a mating circular upper shell 13 hinged in movable relationship to the lower shell 11. The module 12 defines a thin volumetric chamber 14 including a pan 16 for confining a fine iron oxide based makeup powder to a generally thin areally disposed volumetric region. The thin volumetric chamber 14, in this example is generally semicircular, though it may have a rectangular form or other areal shape, such as shown by way of example in FIG. 5 and FIG. 6. A cover 18 mates with the module 12 spaced apart from the pan 16 and is fixed in place along a joint 20, such as by mechanical locking spines or other fastening means, so that the pan 16 cannot be refilled by the consumer. The cover 18 defines an areally disposed array of apertures 22 for sparingly allowing passage of an iron oxide based cosmetic makeup powder 24 disposed on the pan 16. Typically, about 0.02 grams of powder 24 may be loaded on the pan at the factory. The upper portion is sealed so that once the pan 16 is filled and the cover 18 locked or fixed in place, the cover may not be removed. Thus, the only manner in which the makeup powder can escape from the pan 16 is through the apertures 22.

A hinged plate 26 for providing an adhering surface has a substantially nonporous makeup adhering surface provided by a smooth cork lamina 28 glued to the plate 26 for receiving makeup powder 24 from the pan 16. The hinged plate 26 is movable from a first or closed position whereby the adhering cork surface 28 is in facing flush relationship to the cover 18 for receiving the pigmented makeup 24. The apertures are sufficiently small so that only a limited quantity of the powder can escape through the aperture array 22 yet large enough to allow sufficient material to escape to the adhering surface 28. The cover 18 is preferably stiff and planar, though it may have a curved configuration, providing the lamina 28 has a similar matable configuration to engage the cover 18 in facing generally flush relationship.

The plate 26 has a hinge 30 movably fastening the plate 26 to the module 12. Preferably, the plate is integrally molded with the module 12, and the hinge 30 is a "live" hinge and thus a thin flexible plastic portion.

Figure 3:
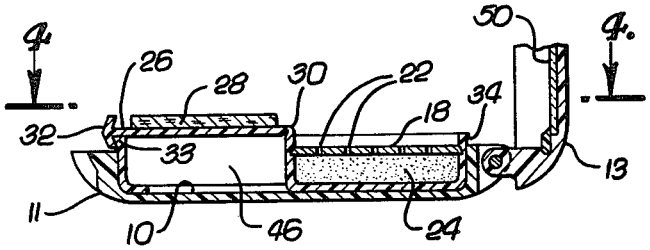
FIG. 3 is a cross-sectional view of an example of the invention depicted in FIG. 1, with the plate in a closed second position also taken along lines 2—2 of FIG. 1.
Figure 4:
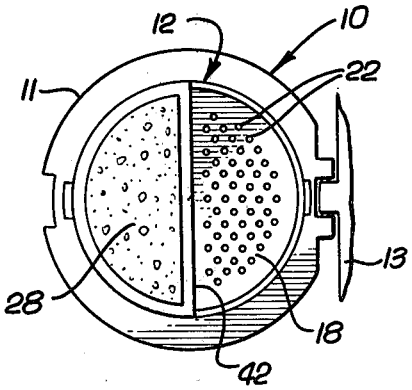
FIG. 4 is a plan view of an example of the invention taken along lines 4—4 of FIG. 3.

The plate 26 is movable to a second or open position as best depicted in FIG. 3, in which the cork surface 28 is moved remote from the apertures 22 to allow the makeup powder 24 on the adhering surface 28 to be removed, such as by a brush, puff or cotton swab and applied to the wearers face. A latch 32 allows the plate 26 to be removably fixed in the second position by engaging a locking tab 33 on the module 12 so that the plate 26 will not move inconveniently when the makeup powder 24 is brushed off the cork surface 28. In addition, the latch 32 also engages a locking portion 34 on the module 12 adjacent the cover to allow the latch 32 to be locked in the first position, when the user desires to dispense the powder 24 on the cork surface 28.

Figure 2:
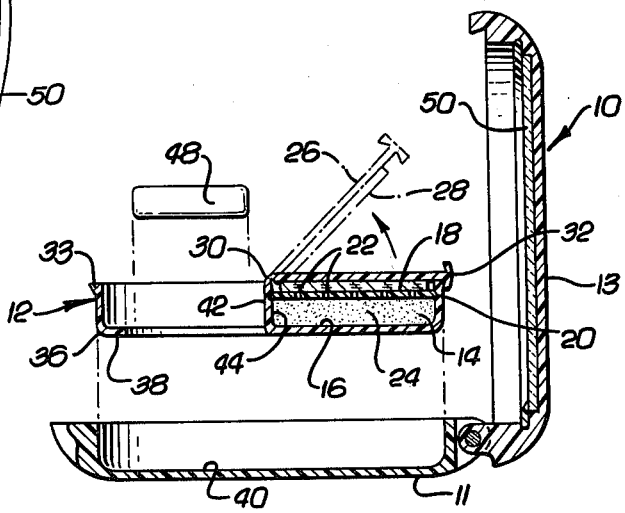
FIG. 2 is an exploded cross-sectional view of the invention taken along lines 2—2 of FIG. 1, with the plate in a closed first position.

As best viewed in FIG. 2, the module 12 comprises an annular portion 36 or loop having a bottom surface 38. The shell 11 of the case 10 has an inner surface 40 for receiving the annular portion 36, either in flat or specially mating relationship. The module 12 is thus joined to the case by gluing or sonic welding, for example, of the bottom surface 38 to the case inner surface 40. The height of the annular portion 36 defines the maximum thickness of the thin volumetric chamber 14. A transverse portion 42 of the module 12 partitions the case 10 and provides a sidewall 44 of the volumetric chamber 14. While a separate pan portion 16 is depicted in FIG. 2 and FIG. 3, it should be understood that the inner surface 40 may serve as the pan 16, and the module 12 may comprise simply an annular portion 36 having a generally rectangular cross-section and a transverse portion 42 dividing the annular portion 36 to partition the case 10. The bond in this situation should be sufficient to contiguously join the transverse portion 42 and the perimeter of the ring portion 36 defining the chamber 14, to render the chamber 14 impervious to the powder and thus maintaining the integrity of the confined volumetric chamber 14. The pan 16 is thus provided by the inner surface 40 of the case 10, the sidewall 44 of the transverse portion 42 and part of the annular portion 36. The living hinge 30 is integral with a substantial length of the transverse portion 42.

Figure 5:
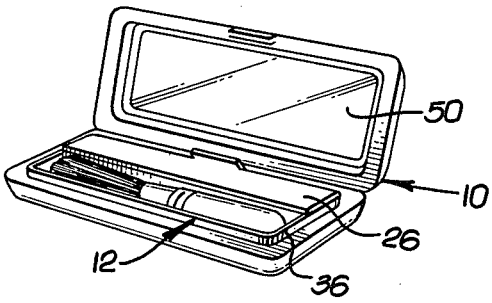
FIG. 5 and FIG. 6 are perspective views of different examples of cosmetic dispensing devices in accordance with this invention.
Figure 6:
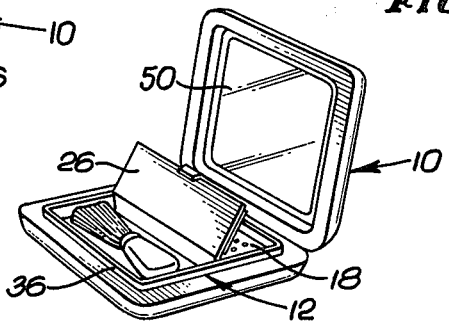

The module 12 and the transverse portion 42 define a second chamber 46 for storing a brush 48, for example. The module 12 may be dimensioned to fit within a standard circular or rectangular stock compact case. The shape of the annular portion 36 or loop, naturally, may take on a rectangular (rather than circular) or other perimeter to appropriately match the case used and define the desired size of the chamber 14, 46. FIGS. 5 and 6 depict different examples of the invention in which the case is rectangular or square. It should be recognized that the loop 36 is then also preferably of rectangular (rather than circular) configuration to define generally rectangular chambers. Glue or ultrasonic welding may be used to affix the module 12 in the hinged compact case 10. A mirror 50 may be affixed to the interior portion of the case 10 opposite the cover 18 so that it is conveniently exposed for use when the plate 26 is moved to the second or open position exposing the cork 28.

In use, the plate 26 is initially locked in the first or closed position, the latch 32 engaging the locking portion 34. The case 10 is shaken a few times, partly depending on the quantity of powder desired to adhere to the cork surface 28, the amount of shaking thus tending to control the amount of material passing through the aperture array 22 to the cork surface 28. The aperture array 22 causes the iron oxide based makeup powder to be dispersed on the cork 28 in a fairly regular manner. The brush 48 being exposed when the plate 26 is in the first position, is removed at this time.

The latch 32 is then unlocked from tab 34 and the plate 26 is moved to the second position, the latch 32 engaging the tab 33. The brush 48 is applied to the cork surface 26, removing the make-up powder which is applied to the face. Residual powder 24 is dispersed on the cover 18 about apertures 22 and may also be removed with the brush 48.

Thus, a powdered makeup compact has been provided which prevents spillage, applies evenly and conveniently to a cork surface, may be carried in a purse, avoids excessive visual exposure to appearance of powder color variations and is nonrefillable and convenient to use.

While the invention has been particularly shown and described with reference to preferred examples thereof, it will be understood by those skilled in the art that various changes in form and details may be made therein without departing from the spirit and scope of the invention.

What is claimed is:

1. An iron oxide based makeup powder dispensing device comprising:

chamber means for confining a fine pigmented powder in a generally thin areally volumetric region;

cover means for preventing escape of the makeup powder from the chamber means, the cover means adjacent said chamber means in facing relationship thereto, and for sparingly allowing passage of the powder therethrough; and plate means for providing a makeup adhering surface and comprising a substantially nonporous makeup adhering surface, the plate means movable from a first position whereby the adhering surface is in facing relationship to the cover means for sparingly receiving the pigmented powder, the plate means movable remote from the first position to allow the makeup to be removed from the adhering surface and applied to a wearer.

2. The invention as set forth in claim 1 and in which the cover means comprises an areally disposed array of apertures in facing relationship to the adhering surface when the plate means is in the first position.

3. The invention as set forth in claim 2 and in which the plate means comprises hinge means coupled to the confinement means, and the cover means comprises locking means for preventing the refilling of the chamber means.

4. The invention as set forth in claim 3 and comprising latching means for securing the plate means in the first position, whereby the makeup powder may pass through the aperture array to the adhering surface without escaping between the plate cover means and the plate means.

5. The invention as set forth in claim 4 and comprising means for securing the plate means in the second position such that the adhering surface is remote from the cover means.

6. The invention as set forth in claim 5 and comprising means for securing the chamber means to a compact case.

7. The invention as set forth in claim 6 and in which the adhering surface comprises cork.

8. The invention as set forth in claim 6 and in which the chamber means comprises a second chamber adjacent the first chamber for storing brush means for applying the powder to the wearer.

9. A cosmetic powder dispensing device comprising:

means for supporting in a confined volumetric region a cosmetic powder;

means for enclosing said confinement means and defining aperture means for sparingly allowing passage of a cosmetic powder from said confinement means; and means for receiving in adhering relationship a cosmetic powder from the confinement means, the cosmetic powder receiving means comprising a substantially nonporous makeup adhering surface and movable from a facing relationship generally flush to the aperture means, to a position remote from the aperture means, so that cosmetic powder when disposed on the cosmetic powder receiving means may be removed and applied to a wearer.

10. The invention as set forth in claim 9 and in which the confinement means defines a thin areally disposed volumetric region.

11. The invention as set forth in claim 10 and in which the aperture means comprises an areally disposed array.

12. The invention as set forth in claim 11 and in which the cosmetic powder receiving means comprises a hinge coupled to the confinement means.

13. A cosmetic powder dispensing device comprising:

an outer compact case;

a module disposed within the case defining a first powder receiving chamber, and an adjacent separated chamber;

the first chamber having an upper portion for receiving an upper cover;

a cover mating with the module at the upper portion of the first chamber, the cover having a plurality of apertures therein, the apertures being areally disposed;

means including a substantially nonporous adhering surface for coupling the adhering surface to the dispensing device, movable from a first position in facing relationship to the upper surface of the upper cover, and adjacent to the apertures thereof;

the adhering surface movable remote from the first position to allow access to applying the makeup powder to a wearer.

14. The invention as set forth in claim 13 and comprising hinge means for movably coupling the adhering surface to the module.

15. The invention as set forth in claim 14 and in which the module comprises a loop having an upright transverse portion dividing the loop into the powder receiving chamber and the adjacent separated chamber, the case having an inner surface, and bond means for joining the loop and the transverse portion to the inner surface of the case to render the adjacent seperated chamber impervious to the make up powder.

16. The invention as set forth in claim 15 and in which the hinge means comprises a longitudinal portion joining the means including an adhering surface to the transverse portion of the module.

17. The invention as set forth in claim 15 and in which the case defines an inner perimeter circumjacent to the loop.

18. The invention as set forth in claim 15 and comprising means for latching the means including the adhering surface to the module in the first position.

19. The invention as set forth in claim 18 and in which the module comprises a circular loop, the first chamber having a shallow, generally semicircular configuration, and the case comprising an application brush disposed within the adjacent separated compartment.

20. The invention as set forth in claim 17 and in which the case is circular and the loop comprises a circular ring having a generally rectangular cross section, and the cover having a generally semicircular configuration.

21. The invention as set forth in claim 17 and in which the case is generally rectangular and the loop has a generally rectangular perimeter and having a rectangular cross section; and the cover having a generally rectangular configuration.

* * * * *